US008783024B2

(12) United States Patent
Ono et al.

(10) Patent No.: US 8,783,024 B2
(45) Date of Patent: Jul. 22, 2014

(54) EXHAUST CHAMBER IN MOTORCYCLE EXHAUST SYSTEM

(75) Inventors: Masashi Ono, Hyogo (JP); Ichiro Tanaka, Kakogawa (JP); Yoshihito Uchino, Kakogawa (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 313 days.

(21) Appl. No.: 13/039,060

(22) Filed: Mar. 2, 2011

(65) Prior Publication Data

US 2011/0225953 A1 Sep. 22, 2011

(30) Foreign Application Priority Data

Mar. 19, 2010 (JP) ..... 2010-063672

(51) Int. Cl.

| | |
|---|---|
| ***F01N 3/00*** | (2006.01) |
| ***F01N 3/10*** | (2006.01) |
| ***F01N 1/00*** | (2006.01) |
| ***F01N 13/02*** | (2010.01) |
| ***F01N 1/08*** | (2006.01) |
| ***F01N 13/08*** | (2010.01) |

(52) U.S. Cl.
USPC ..... 60/299; 60/276; 60/324; 181/227; 181/232; 181/269

(58) Field of Classification Search
USPC ..... 60/276, 287, 299, 324; 181/227, 232, 181/255, 269
See application file for complete search history.

(56) References Cited

U.S. PATENT DOCUMENTS

| | | | | |
|---|---|---|---|---|
| 4,279,326 | A * | 7/1981 | Meineke et al. | 181/228 |
| 5,514,348 | A * | 5/1996 | Bayer et al. | 422/177 |
| 7,699,134 | B2 | 4/2010 | Terashima et al. | |
| 7,905,320 | B2 | 3/2011 | Ishikawa et al. | |
| 8,109,084 | B2 | 2/2012 | Morita et al. | |
| 2006/0201742 | A1 * | 9/2006 | Terashima et al. | 181/227 |
| 2006/0242952 | A1 * | 11/2006 | Muramatsu et al. | 60/299 |
| 2007/0039317 | A1 * | 2/2007 | Momosaki et al. | 60/299 |
| 2008/0110155 | A1 | 5/2008 | Harada | |
| 2008/0110693 | A1 * | 5/2008 | Muto | 181/250 |
| 2008/0236151 | A1 | 10/2008 | Morita et al. | |
| 2008/0236941 | A1 | 10/2008 | Ishikawa et al. | |

FOREIGN PATENT DOCUMENTS

| | | | | |
|---|---|---|---|---|
| JP | 09203310 | A * | 8/1997 | F01N 1/02 |
| JP | 2003-206738 | | 7/2003 | |
| JP | 2007-008442 | | 1/2007 | |
| JP | 2007-046548 | | 2/2007 | |
| JP | 2008-106644 | | 5/2008 | |
| JP | 2008-255794 | | 10/2008 | |
| JP | 2008-255800 | | 10/2008 | |

OTHER PUBLICATIONS

Japanese Application No. 2010-063672 Office Action dated Sep. 3, 2013, 6 pages with partial English translation.

* cited by examiner

*Primary Examiner* — Audrey K Bradley

(57) ABSTRACT

An exhaust chamber (34) for a motorcycle is disposed at a location upstream of a muffler (36) of an exhaust passage (38) leading from a combustion engine (E). The exhaust chamber (34) includes a chamber body (40) having expansion compartments (41, 42, 43) defined therein, a chamber outlet pipe (46) having an outlet passage defined therein for discharging the exhaust gases (G) from the chamber body (40), and an exhaust control valve (72) disposed in the chamber outlet pipe (46) for adjusting the sectional area of the outlet passage inside the chamber outlet pipe (46).

4 Claims, 8 Drawing Sheets

EXHAUST CHAMBER IN MOTORCYCLE EXHAUST SYSTEM

CROSS REFERENCE TO THE RELATED APPLICATION

This application is based on and claims Convention priority to Japanese patent application No. 2010-63672, filed Mar. 19, 2010, the entire disclosure of which is herein incorporated by reference as a part of this application.

BACKGROUND OF THE INVENTION

1. Field of the Invention

The present invention relates to an exhaust chamber in the motorcycle exhaust system and, more particularly, to an exhaust chamber disposed on the motorcycle exhaust system at a location upstream of a muffler.

2. Description of the Related Art

The motorcycle exhaust system of a type having an exhaust control valve disposed at a location upstream of the muffler for adjusting the opening of the exhaust passage has been known. In this motorcycle exhaust system, it has been recognized that disposition of the exhaust control valve inside the muffler or the exhaust pipe is apt to impose a limitation on the freedom of design choice such as, for example, layout and/or material for the muffler or an exhaust pipe. To alleviate the limitation on the freedom of design choice, the Japanese Laid-open Patent Publication No. 2008-106644, first published May 8, 2008, discloses the use of an exhaust chamber, disposed upstream of the muffler and including communicating pipes communicated with a plurality of expansion compartments, and an exhaust control valve disposed within at least one of the communicating pipes for adjusting the sectional area of a passage inside such one of the communicating pipe.

However, according to the previously mentioned patent document, the exhaust control valve is disposed within the communicating passage inside the exhaust chamber, and, accordingly, the internal structure of the exhaust chamber tends to be complicated. In addition, the exhaust control valve employed require complicated maintenance and servicing works.

SUMMARY OF THE INVENTION

In view of the foregoing, the present invention has been devised to substantially alleviate the problems and inconveniences inherent in the prior art and is intended to provide an exhaust chamber in a motorcycle exhaust system, which has a simplified internal structure notwithstanding the use of the exhaust control valve within such exhaust chamber.

In order to accomplish the foregoing object, the present invention provides an exhaust chamber for a motorcycle disposed at a location upstream of a muffler in an exhaust passage leading from a combustion engine. The exhaust chamber includes a chamber body having an expansion compartment defined therein, a chamber outlet pipe having an outlet passage defined therein for discharging the exhaust gases from the chamber body, and an exhaust control valve disposed in the chamber outlet pipe for adjusting a sectional area of the outlet passage inside the chamber outlet pipe.

According to this construction, the use is made of the chamber outlet pipe having the exhaust control valve built therein and, therefore, the structure of the chamber body having the expansion compartment can be made simple to simplify the internal structure of the exhaust chamber, resulting in an increase of the assemblability of the exhaust chamber. Also, access to the exhaust control valve can be made easy and, therefore, the maintenance and servicing of the exhaust control valve can be facilitated.

In one preferred embodiment of the present invention, the exhaust chamber of the type referred to above preferably includes an chamber inlet pipe, which protrudes in an upstream direction from the chamber body for allowing the exhaust gases to flow therethrough into the chamber body; an introducing pipe having an introducing passage defined therein, which introducing pipe is disposed within the chamber body for introducing the exhaust gases, which have flowed through the chamber inlet pipe, into the chamber body; and a catalytic unit disposed within the introducing passage inside the introducing pipe for purifying the exhaust gases.

Disposition of the catalytic unit in the introducing pipe that is a member separate from the muffler allows the freedom of choice of the layout of and the material for the exhaust pipe and the muffler to expand. Also, since the exhaust control valve and the catalytic unit are integrated within the exhaust chamber, not only can the number of component parts used be reduced to suppress the cost, but also the motorcycle exhaust system can be laid out in a compact size. Moreover, since the catalytic unit is arranged at the inlet to the chamber body, the distance from the exhaust port of the combustion engine to the catalytic unit can be reduced to such an extent as to permit the temperature of the catalytic converter to be warmed up at the time the combustion engine is started, thus facilitating a quick activation of the catalyst in the catalytic converter.

In another preferred embodiment of the present invention, particularly where the exhaust chamber makes use of the catalytic unit as discussed above, the use may be made of a sensor fitted to the chamber inlet pipe for detecting a composition of the exhaust gases within the exhaust passage. The use of the exhaust gas sensor mounted on the chamber inlet pipe is effective to simplify the structure of the chamber body having the expansion compartment defined therein. Also, since in addition to the exhaust control valve and the catalytic unit, the exhaust gas sensor is as well integrated with the exhaust chamber, the number of component parts used can be further reduced and, therefore, reduction in cost and compactization of the motorcycle exhaust system can be accomplished advantageously.

In a further preferred embodiment of the present invention, particularly where the exhaust chamber makes use of the catalytic unit and the exhaust gas sensor as discussed above, the chamber inlet pipe may be positioned rearwardly downwardly of the combustion engine so as to extend in a direction longitudinally of the motorcycle and the sensor is fitted to the chamber inlet pipe so as to protrude diagonally upwardly and outwardly from the chamber inlet pipe. This is particularly advantageous that since the exhaust gas sensor protrudes diagonally upwardly and outwardly from the chamber inlet pipe, it is possible to avoid any undesirable interference of the sensor and a sensor cable with the combustion engine, the motorcycle frame structure and others and, also, the motorcycle bank angle can be earned.

In a still further preferred embodiment of the present invention, particularly where the exhaust chamber makes use of the catalytic unit as discussed above, the exhaust chamber may be made of the same material as a catalyst carrier accommodated inside the catalytic unit. The use of the material for the exhaust chamber, which is the same as that for the catalyst carrier, does in effect eliminate welding between dissimilar metals, and therefore, the welding quality can be increased.

In a still further preferred embodiment of the present invention, the chamber outlet pipe may be positioned at a location laterally of the motorcycle and between the combustion engine and a rear wheel so as to extend rearwardly and, also, the exhaust control valve may include a valve spindle, a valve operating member for driving the valve spindle, and a valve body mounted on the valve spindle for movement together therewith so as to form a butterfly valve, in which case the valve spindle is inclined in a direction inwardly of the motorcycle to allow the valve operating member to approach a center of the motorcycle. This design feature is particularly advantageous in that the possibility of the operating member for the exhaust control valve contacting a rider's foot can be avoided.

In a still further preferred embodiment of the present invention, a plurality of expansion compartments and a resonance compartment may be arranged inside the chamber body and the expansion compartment on the downstream end side or extreme downstream side with respect to the direction of flow of the exhaust gases and the resonance compartment are communicated with each other. This is particularly advantageous in that since the resonant frequency within the expansion compartment is lowered because of the temperature inside such expansion compartment being lower than that inside the expansion compartment on the upstream side, adjustment of the resonant frequency can be facilitated.

The present invention also provides a motorcycle equipped with the exhaust chamber of the type referred to above. The exhaust chamber mounted on the motorcycle includes a chamber inlet pipe for introducing exhaust gases into the chamber body, with the chamber body being positioned below the motorcycle and between the combustion engine and a rear wheel located rearwardly of the combustion engine. The chamber inlet pipe is positioned at a location substantially intermediate of a width of the motorcycle so as to protrude from the chamber body towards a space below the combustion engine while the chamber outlet pipe is positioned on one side of the motorcycle so as to protrude outwardly slantwise from the chamber body towards a space laterally of the rear wheel. With the motorcycle so designed as described above, an undesirable interference between the chamber inlet pipe and the combustion engine as well as between the chamber outlet pipe and the rear wheel can be advantageously avoided and, at the same time, the chamber body disposed between the combustion engine and the rear wheel can have a capacity as large as possible.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF THE PREFERRED EMBODIMENTS

Figure 1:
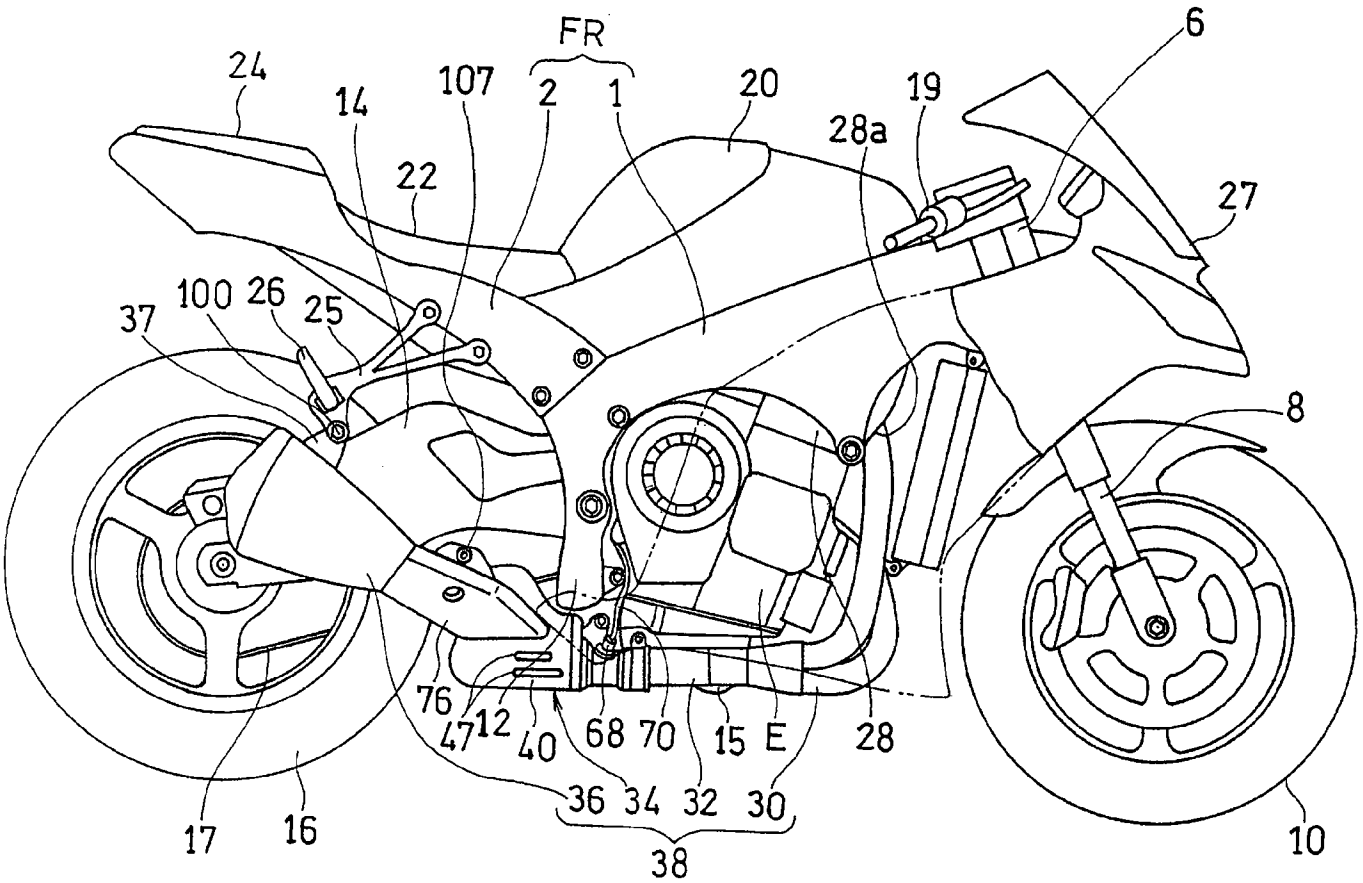
FIG. 1 is a schematic side view of a motorcycle provided with an exhaust chamber in accordance with a preferred embodiment of the present invention.

Preferred embodiments of the present invention will now be described in detail with reference to the accompanying drawings. In particular, FIG. 1 illustrates a schematic side view of a motorcycle equipped with an exhaust chamber designed according to a first preferred embodiment of the present invention. The motorcycle shown in FIG. 1 includes a motorcycle frame structure FR made up of a main frame assembly 1, forming a front part of the motorcycle frame structure FR, and a rear frame assembly 2 coupled with a rear portion of the main frame assembly 1 and forming a rear part of the motorcycle frame structure FR. A front fork 8 is rotatably supported by a head tube 6 at a front end of the main frame assembly 1 through a steering shaft (not shown), and a front wheel 10 is rotatably supported by the front fork 8 in any manner known to those skilled in the art.

A swingarm bracket 12 is secured to a rear end of the main frame assembly 1, which is situated at a lower intermediate portion of the motorcycle frame structure FR, and a swingarm 14 is pivotally connected to the swingarm bracket 12 for movement up and down, with a rear wheel 16 supported by this swingarm 14. A combustion engine E is fixedly mounted on that lower intermediate portion of the motorcycle frame structure FR and forwardly of the swingarm bracket 12 with respect to the direction of forward travel of the motorcycle so that the rear wheel 16 can be driven by the motorcycle engine E through a power transmitting member 17 such as a drive belt. The motorcycle engine E has a rear portion thereof having a transmission (not shown) built therein, and an oil pan 15 for accommodating a quantity of lubricant oil therein is positioned below the motorcycle engine E.

A motorcycle steering handlebar 19 is fixedly mounted on an upper end of the front fork 8. A fuel tank 20 is mounted on an upper portion of the main frame assembly 1 and a seat assembly including a driver's seat 22 and a rear fellow passenger's seat 24 is mounted on the rear frame assembly 2 in any manner well known to those skilled in the art. A rear footrest 26 for the fellow passenger is fixed to the rear frame assembly 2 through a footrest bracket 25. Also, a region of the motorcycle ranging from a top forward area of the front fork 8 to opposite side areas laterally of a front portion of the motorcycle body is covered by a fairing 27 made of a resinous material, with a rear portion of such fairing 27 covering opposite side portions and a lower portion of the motorcycle engine E.

The motorcycle engine E employed the instance as shown is in the form of a parallel four cylinder four-stroke engine and has four exhaust ports 28*a* defined at a front end portion of a cylinder head 28 of the engine E and four exhaust pipes 30 for guiding exhaust gases downwardly from a front area of the engine E are fluidly connected with those four exhaust ports 28*a*. Those four exhaust pipes 30 are merged together by a collecting duct 32 positioned beneath the engine E, and an exhaust chamber 34 is fluidly connected with a downstream end portion of the collecting duct 32. The exhaust chamber 34 is positioned between a bottom area of the engine E and the rear wheel 16, more specifically between the oil pan 15 beneath the engine E and the rear wheel 16 and generally below the swingarm bracket 12.

At a location rightwards of the motorcycle body with respect to the direction of forward travel of the motorcycle and downstream of the exhaust chamber 34, a muffler 36 made of a titanium or a titanium alloy (hereinafter, referred collectively to as a "titanium material") is fluidly connected with the exhaust chamber 34. This muffler 36 has a mounting fixture 37 and is supported by one of the fellow passenger's footrest bracket 25 with the mounting fixture 37 secured to a mounting member 100 such as, for example, a bolt. Material for the muffler 36 may not necessarily be limited to the titanium material. The exhaust pipes 30, the collecting duct 32, the exhaust chamber 34 and the muffler 36 altogether forms a motorcycle exhaust passage 38.

Figure 2:
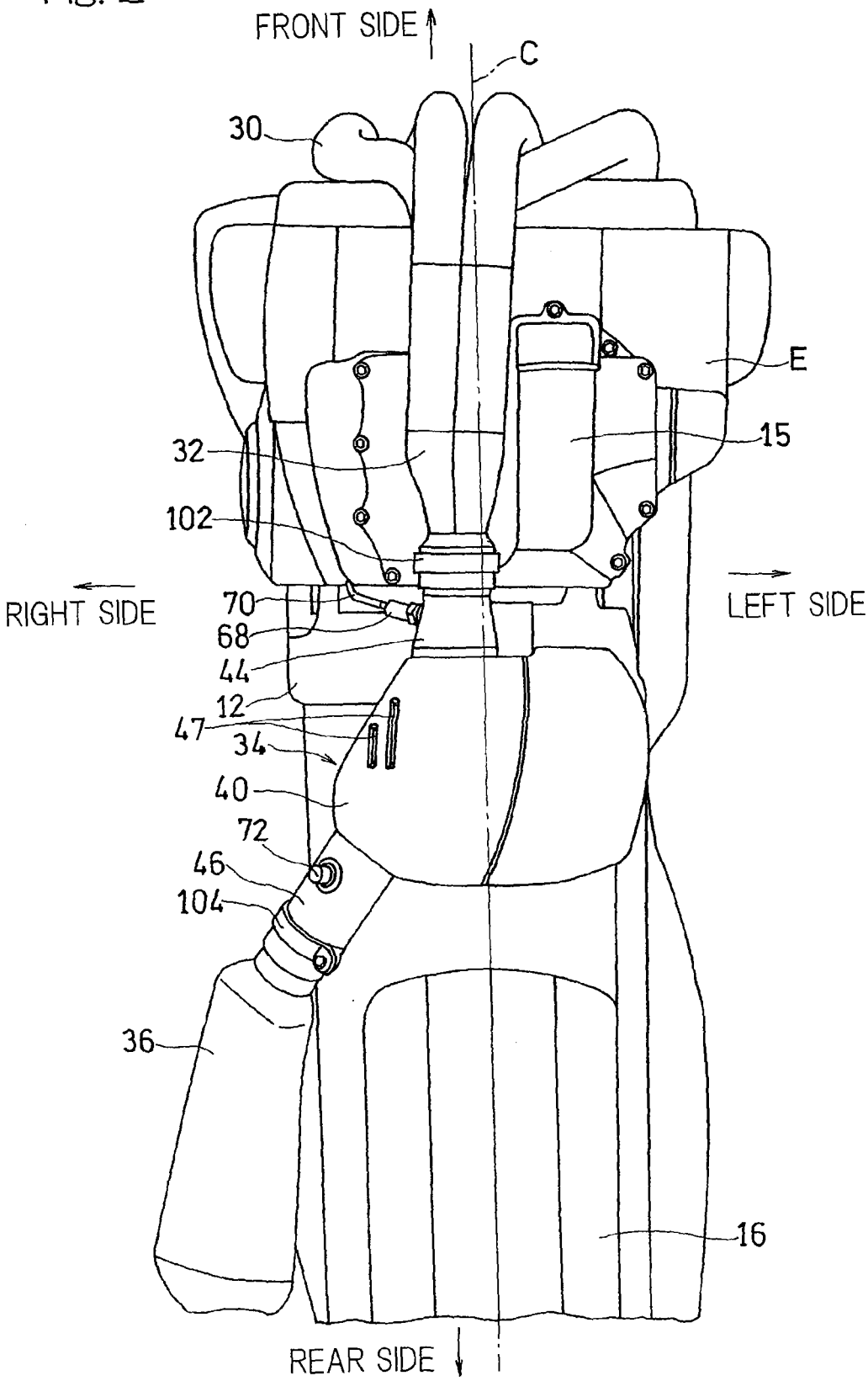
FIG. 2 is a fragmentary bottom plan view, showing a portion of the motorcycle on an enlarged scale as viewed from bottom thereof.

As shown in a fragmentary bottom plan view in FIG. 2, the collecting duct 32 is arranged in the vicinity of a longitudinal center line C in a plane view of the motorcycle, that is, a center region of a widthwise direction of the motorcycle, and at a location beneath the engine E so as to extend in a direction lengthwise of the motorcycle. In the illustrated embodiment, the four exhaust pipes 30 and the collecting duct 32 are all made of a stainless steel (hereinafter, simply referred to as a "stainless material"), but they may be made of any other metal such as, for example, titanium. The exhaust chamber 34 includes a chamber body 40 having three expansion compartments defined therein as will be described in detail later. The chamber body 40 is arranged rearwardly downwardly of the engine E so as to occupy a position generally lying on the longitudinal center line C of the motorcycle. More specifically, a center line of the chamber body 40 in the widthwise direction is substantially coincident with the center line C of the motorcycle.

The chamber body 40 has front and rear ends oriented forwards and rearwards of the motorcycle, respectively, with respect to the direction of forward travel of the motorcycle, and a right-hand portion of the forward end of the chamber body 40 as best shown in FIG. 2, has a chamber inlet pipe 44 fluidly connected therewith by means of a suitable connecting means such as, for example, welding so as to protrude in a direction forwards of the motorcycle, which is on an upstream side with respect to the direction of flow of exhaust gases from the engine E to the atmosphere, that is, in a direction towards a space beneath the engine E. Also, a right-hand portion of the rearward end of the chamber body 40, that is, one lateral side of the motorcycle has a chamber outlet pipe 46 fluidly connected therewith by means of a suitable connecting means such as, for example, welding so as to protrude from the chamber body 40 towards a space in a right-hand region of the rear wheel 16, that is, in a direction diagonally rearwardly of the motorcycle and laterally away or outwardly from the motorcycle. In this way, the chamber body 40, the chamber inlet pipe 44 and the chamber outlet pipe 46 are integrated together to define the exhaust chamber 34.

The chamber inlet pipe 44 is positioned at a site substantially intermediate of the width of the motorcycle and extends in a direction conforming to the longitudinal direction of the motorcycle, terminating in fluid connection with a downstream end of the collecting duct 32. On the other hand, the chamber outlet pipe 46 extends in a direction laterally outwardly or rightwardly of the motorcycle and is fluidly connected with an upstream end of the muffler 36. The chamber body 40, the chamber inlet pipe 44 and the chamber outlet pipe 46 are all made of a metallic material such as, for example, the stainless material referred to previously.

Figure 3:
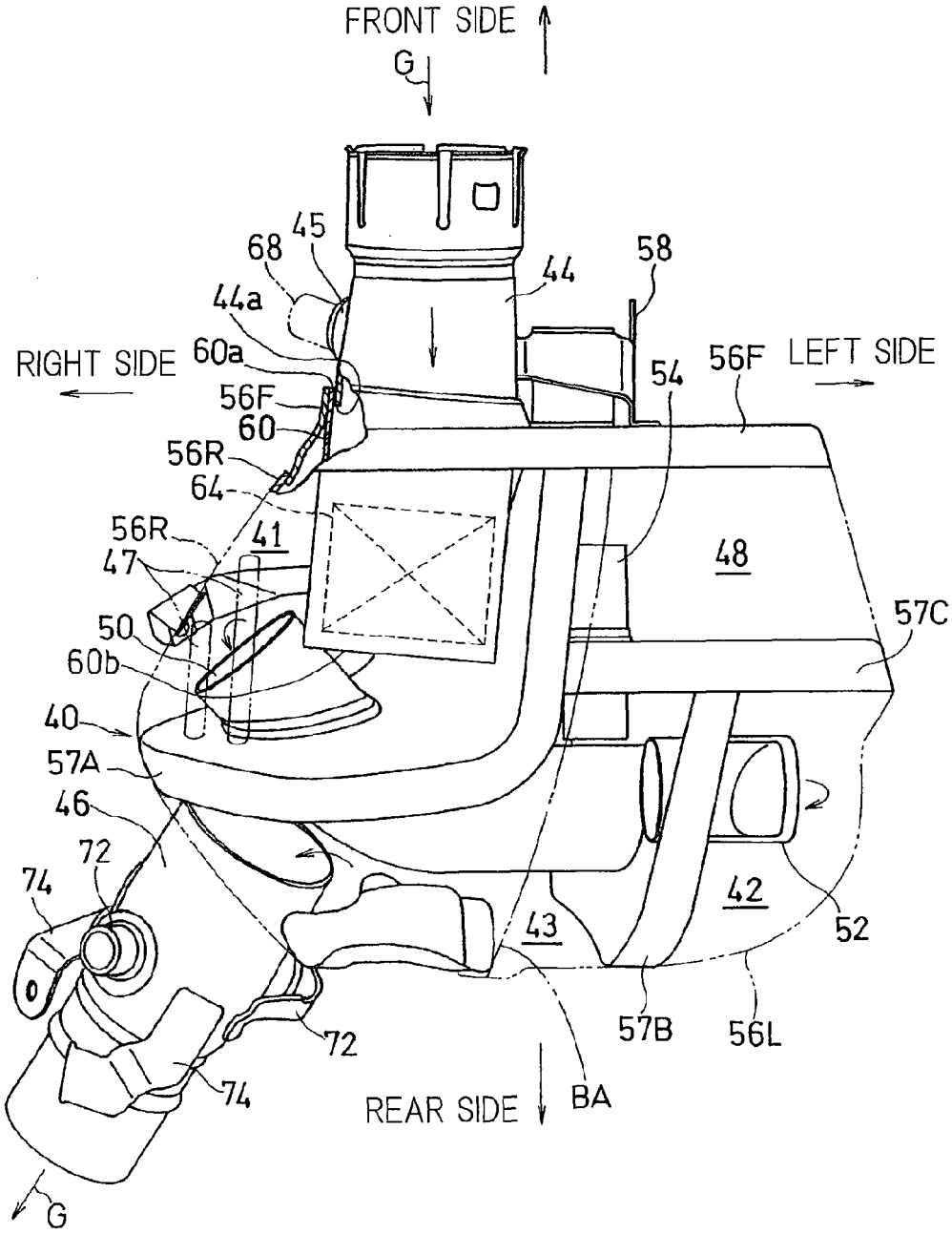
FIG. 3 is a bottom plan view showing an exhaust chamber shown in FIG. 2.

As shown in an enlarged bottom plan view in FIG. 3, the chamber body 40 includes a casing structure 56 made of a stainless sheeting. The casing structure 56 is made up of a right casing 56R positioned on a right side when the exhaust chamber 44 is mounted on the motorcycle, a left casing 56L positioned on a left side when the exhaust chamber 44 is mounted on the motorcycle, and a front casing 56F forming a front portion of the chamber body 40, all of those casings 56R, 56L and 56F being integrated together by means of welding. More specifically, the right casing 56R and the left casing 56L are joined together to form a casing subassembly which has a front side opening to the outside and this opened front side is closed when and after the front casing 56F is joined with the subassembly of the right and left casings 56R and 56L. A boundary between the right and left casings 56R and 56L is indicated by a double dotted chain line BA. The front casing 56F has the chamber inlet pipe 44 fluidly connected therewith on the right side thereof. The chamber outlet pipe 46 is fixedly inserted into a rear end of the right casing 56R.

The chamber body 40 has its interior divided into a first expansion compartment 41, a second expansion compartment 42, a third expansion compartment 43 and a resonance compartment 48 by three partition walls 57A, 57B and 57C fitted inside inner surfaces of the casing structure 56. The first and second expansion compartments 41 and 42 are in communication with each other by means of a first communicating pipe 50, fitted to the first and second partition walls 57A and 57B, and the second and third expansion compartments 42 and 43 are in communication with each other by means of a second communicating pipe 52 fitted to the second partition wall 57B.

The chamber body 40 referred to above is formed integrally with a mounting lug 58 protruding outwardly from the front casing 56F and is supported by the swingarm bracket 12 by means of a set bolt 106 engaged in such mounting member 58.

The chamber inlet pipe 44 has a downstream end is opened to and communicated with the first expansion compartment 41 and the chamber outlet pipe 46 has an upstream end communicated with the third expansion to compartment 43. Also, the third expansion compartment 43 and the resonance compartment 48 are communicated with each other by means of a connecting pipe 54 fitted to the third partition wall 57C.

The partition walls 57A to 57C and the communicating pipes 50, 52 and 54 are all made of the stainless material, but they may not necessarily be limited thereto. Also, the number of the expansion compartments may not necessarily limited to three such as shown and described and the resonance compartment 48 may be dispensed with if so desired. In addition, though in this embodiment the resonance compartment 48 is communicated with the downstream end expansion compartment, the resonance compartment 48 may alternatively be communicated with an expansion compartment other than the downstream end compartment, that is, the upstream end expansion compartment or an intermediate expansion compartment intervening between the upstream and downstream end expansion compartments.

The first expansion chamber 41, best shown in FIG. 3, is formed in a front right portion of the chamber body 40 by means of the right casing 56R and the front casing 56F and the first partition wall 57A bent at a substantial angle of 90°, and is adjoining the resonance compartment 48, positioned on a left side thereof, and the third expansion compartment 43, positioned rearwardly thereof, through the first partition wall 57A. A portion of the right casing 56R, which forms a wall surface of the first expansion compartment 41, is formed with a recess 47 depressed in a direction inwardly of the first expansion compartment 41. In the illustrated embodiment now under discussion, two elongated recesses 47, each extending in a direction parallel to the longitudinal sense of the motorcycle, are formed one above the other so as to be depressed inwardly of the first expansion compartment 41, but the particular number of the recesses and the shape thereof may not necessarily be limited to those shown and described above. In any event, as best shown in FIG. 1, in a condition with the exhaust chamber 34 mounted on the motorcycle, those recesses 47 are exposed to the outside of the motorcycle.

Referring to FIG. 3, the second expansion compartment 42 is positioned at a location rearwardly leftwards of the chamber body 40 and is defined by the left casing 56L, the second partition wall 57B extending in the longitudinal direction, and a left half of the third partition wall 57C extending in a direction widthwise of the motorcycle. This second expansion compartment 42 is adjoining the third expansion compartment 43, positioned on the right side thereof, through the second partition wall 57B and the resonance compartment 48, positioned on the front side thereof, through the third partition wall 57C. The first communicating pipe 50 extends through a rear wall portion of the first partition wall 57A, which is curved, that is, a boundary between the first and third expansion compartments 41 and 43, and is communicated with the second expansion compartment 42 after having crossed the interior of the third expansion compartment 43 in a direction widthwise of the motorcycle and then through the second partition wall 57B.

The third expansion compartment 43 is positioned at a location rearwardly rightwards of the chamber body 40 and is adjoining the first expansion compartment 41, which is positioned on the front side thereof, through the first partition wall 57A, the second expansion compartment 42, which is positioned on the left side thereof, through the second partition wall 57B, and the resonance compartment 48, which is positioned on the front side thereof, through a right half of the third partition wall 57C. The second communicating pipe 52 extends through the second partition wall 57B so as to communicate the second expansion compartment 42 and the third expansion compartment 43 with each other.

The resonance compartment 48 is positioned forwardly leftwards of the chamber body 40 and is adjoining the first expansion chamber 41, which is positioned on the right side thereof, through the first partition wall 57A, and the second and third expansion compartments 42 and 43, both positioned on the rear side thereof, through left and right halves of the third partition wall 57C, respectively. The connecting pipe 54 extends through the right half of the third partition wall 57C so as to communicate the third expansion compartment 43 and the resonance compartment 48 with each other.

An introducing pipe 60 in the form of a pipe made of the stainless material is disposed inside the first expansion compartment 41. One end portion 60*a* of the introducing pipe 60 is fitted to an opening of the front casing 56F by means of a connecting means, for example, welding so as to be capped onto a downstream end 44*a* of the chamber inlet pipe 44, whereas the opposite end portion 60*b* thereof is left to open into the first expansion compartment 41. An introducing passage inside this introducing pipe 60 has a catalytic unit 64 disposed therein for substantially purifying the exhaust gases G.

Figure 5:
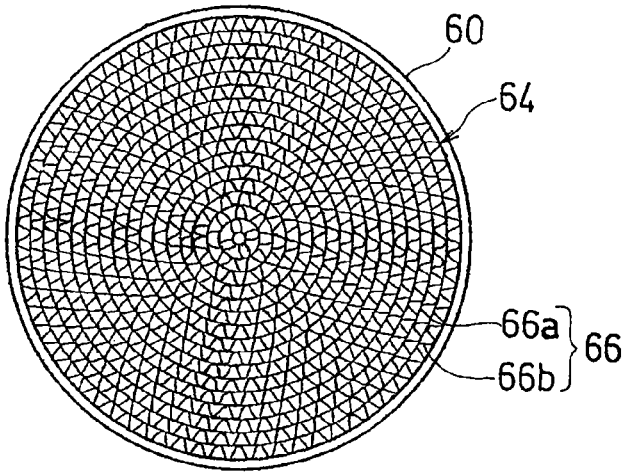
FIG. 5 is a schematic transverse sectional view showing a catalytic converter disposed within the exhaust chamber in the motorcycle exhaust system.

As best shown in FIG. 5, the catalytic unit 64 is of a honeycomb structure having a multiplicity of cells arranged in directions circumferentially and radially thereof. Specifically, this catalytic unit 64 is of a round sectioned structure including a plurality of cylindrical flat plates 66*a* and a corresponding number of generally cylindrical corrugated plates 66*b*, which are coaxially alternated one inside the other to define the multiplicity of the cells. A catalyst such as, for example, platinum or rhodium is baked on and carried by the flat plates 66*a* and the corrugated plates 66*b*. This catalytic. unit 64 is so arranged that an axial direction of the cylindrical honeycomb structure, that is, directions of the cells can be aligned with the direction of flow of the exhaust gases G.

Figure 4:
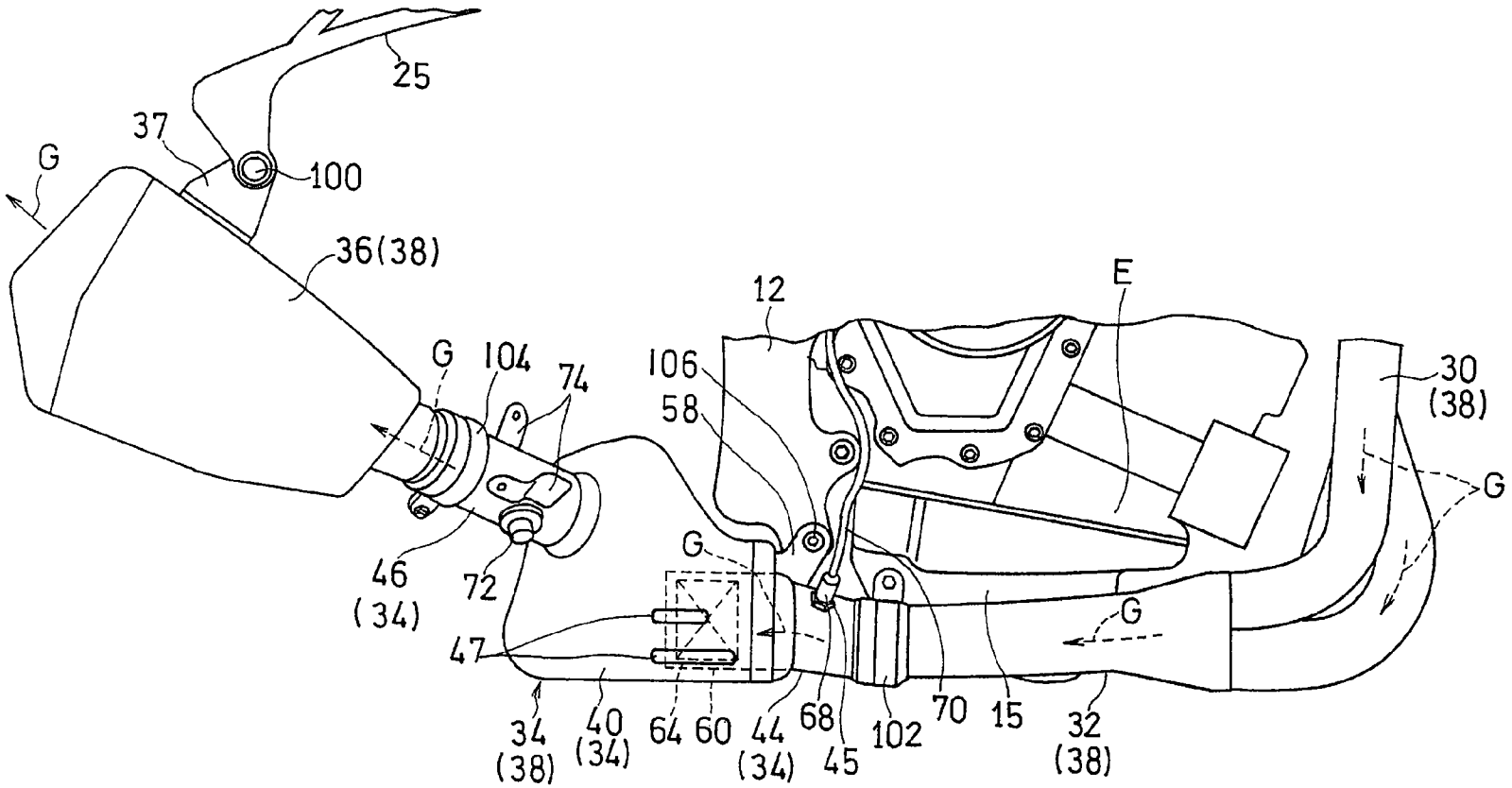
FIG. 4 is a side view showing, on an enlarged scale, an exhaust system employed in the motorcycle shown in FIG. 1.

As best shown in FIG. 4, an exhaust gas sensor 68 for detecting the composition of the exhaust gases G flowing within the exhaust passage 38 is fitted to the chamber inlet pipe 44, that is, disposed at a location upstream of the catalytic unit 64. In the illustrated embodiment now under discussion, for the exhaust gas sensor 68, an oxygen sensor 68 is employed. This oxygen sensor 68 is fitted to the chamber inlet pipe 44 by screwing the sensor 68 into a sensor threading boss 45 disposed on the chamber inlet pipe 44 so as to protrude to diagonally upwardly and outwardly from an upper portion of the chamber inlet pipe 44. It is, however, to be noted that the manner of fitting the sensor 68 may not necessarily be limited to such as shown and described above.

A detection signal from the oxygen sensor 68 is fed to an engine controller (not shown) through a cable 70, and the engine controller controls the amount of a secondary air to be blown into the exhaust ports 28*a* (FIG. 1) and the air/fuel ratio in the motorcycle fuel intake system in dependence on the detection signal to allow a catalytic reaction to take place smoothly within the catalytic unit 64. The oxygen sensor 68 and the cable 70 are, as best shown in FIG. 1, externally covered by the fairing 27 and are not exposed to the outside accordingly. This fairing 27 has a rear end portion also covering a portion of the front of the chamber body 40.

Figure 6:
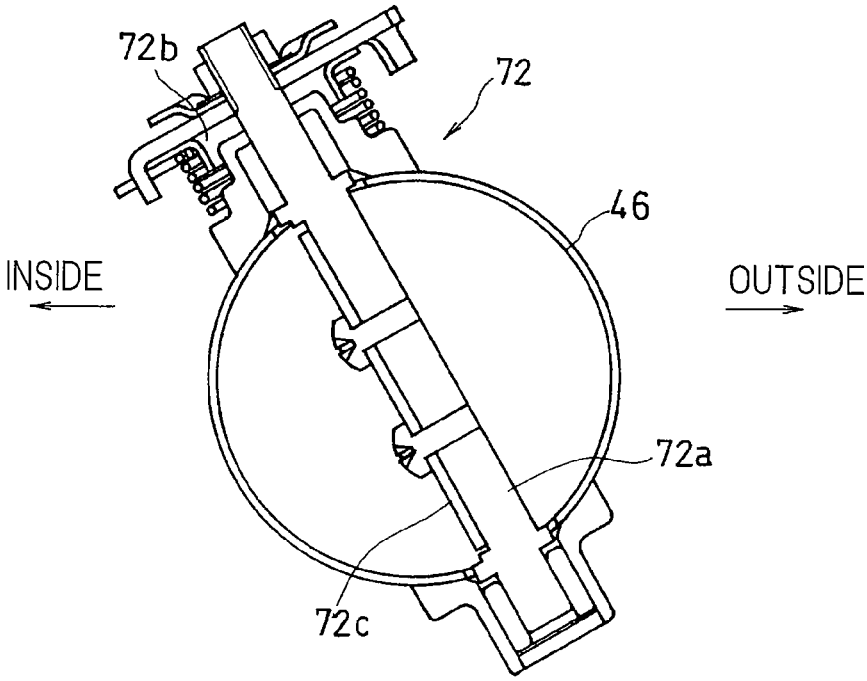
FIG. 6 is a schematic transverse sectional view showing the exhaust control valve within the exhaust chamber in the motorcycle exhaust system.

Referring still to FIG. 4, the chamber outlet pipe 46 is provided with an exhaust control valve 72 for adjusting the passage sectional area of an outlet passage defined inside the chamber outlet pipe 46. In the illustrated embodiment now under discussion, the exhaust control valve 72 is employed in the form of a butterfly valve. As best shown in FIG. 6, the exhaust control valve 72 includes a valve spindle 72*a* extending in a direction perpendicular to the direction of flow of the exhaust gases G, a valve operating member 72*b* for driving the valve spindle 72*a*, and a substantially round plate valve body 72*c* mounted on the valve spindle 72*a* for rotation together therewith and operable to adjust the passage sectional area as it rotates together with the valve spindle 72*a*. The valve spindle 72*a* of the butterfly valve is inclined in a direction confronting the widthwise center of the body of the motorcycle so that the operating member 72*b* may approach the center of the body of the motorcycle. FIG. 6 illustrates a fully opened position of the valve body 72*c*. It is to be noted that the fully opened position of the valve body 72*c* is shown by the solid line in FIG. 8, and a fully closed position is shown by the double dotted chain line in FIG. 8.

As best shown in FIG. 3, the chamber outlet pipe 46 has a plurality of, for example, two mounting fixtures 74 secured thereto, and as shown in FIG. 1, an exhaust cowling 76 is supported by bolts 107 through those mounting fixtures 74. The exhaust cowling 76 so mounted overlays the chamber outlet pipe 46, the exhaust control valve 72 and a rear portion of a right wall of the chamber body 40 to thereby provide an appealing appearance.

Figure 7:
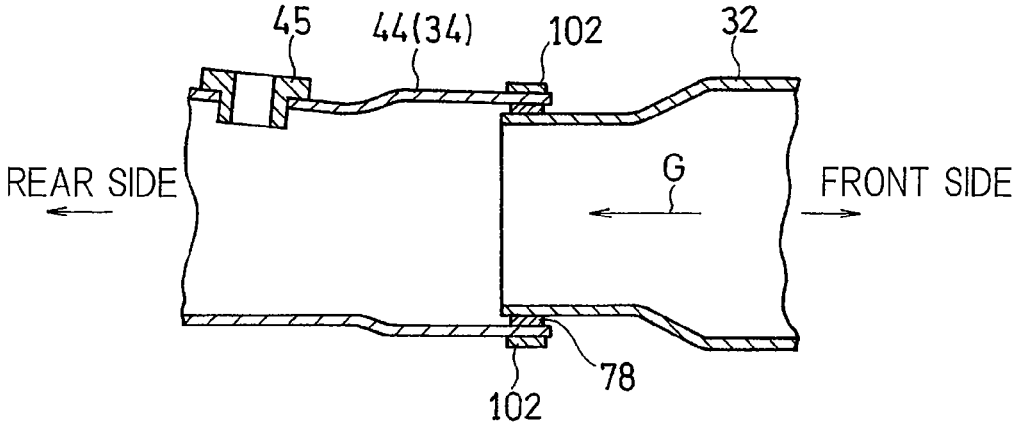
FIG. 7 is a fragmentary longitudinal sectional view showing a joint between the exhaust chamber and a collecting duct in the motorcycle exhaust system.

FIG. 7 illustrates a sectional view showing the joint between the chamber inlet pipe 44 of the exhaust chamber 34 and the collecting duct 32. As shown therein, a rear end portion of the collecting duct 32 is undersized in diameter relative to a front end portion of the chamber inlet pipe 44 and the rear end portion of the collecting duct 32 is inserted into the front end portion of the chamber inlet pipe 44. An annular sealing member 78 interposed between an outer peripheral surface of the rear end portion of the collecting duct 32 and an inner peripheral surface of the front end portion of the chamber inlet pipe 44, the rear end portion of the collecting duct 32 and the front end portion of the chamber inlet pipe 44 are fluidly connected together by means of a connecting member 102 such as, for example, a clamp made of steel.

Figure 8:
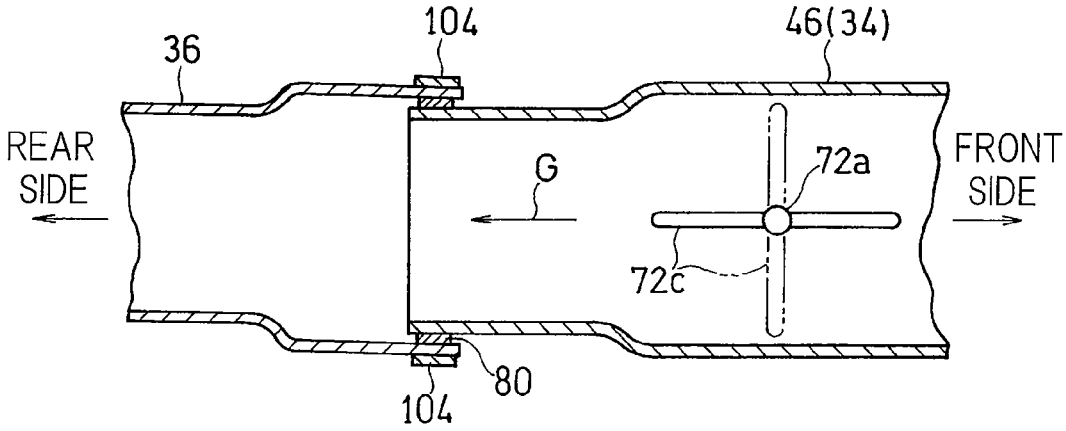
FIG. 8 is a fragmentary longitudinal sectional view showing a joint between the exhaust chamber and a muffler in the motorcycle exhaust system.

FIG. 8 illustrates a sectional view showing the joint between the chamber outlet pipe 46 of the exhaust chamber 34 and the muffler 36. As shown therein, a rear end portion of the chamber outlet pipe 46 is undersized in diameter relative to a front end portion of the muffler 36 and the rear end portion of the chamber outlet pipe 46 is inserted into the front end portion of the muffler 36. An annular sealing member 80 interposed between an outer peripheral surface of the rear end portion of the chamber outlet pipe 46 and an inner peripheral surface of the front end portion of the muffler 36, the rear end portion of the chamber outlet pipe 44 and the front end portion of the muffler 36 are fluidly connected together by means of a connecting member 104 such as, for example, a clamp made of steel.

The flow of the exhaust gases G emitted from the motorcycle engine E will now be described with particular reference to FIGS. 3 and 4. The exhaust gases G from the motorcycle engine E are discharged into the four exhaust pipes 30 and are subsequently merged together within the collecting duct 32. The exhaust gases G flowing in the collecting duct 32 is then supplied into the chamber body 40 through the chamber inlet pipe 44. During the flow of the exhaust gasses G through the chamber inlet pipe 44, the content of oxygen in the exhaust gases G is detected by the oxygen gas sensor 68 mounted on the chamber inlet pipe 44 in the manner as hereinbefore described.

The exhaust gases G within the chamber inlet pipe 44 are introduced into the chamber body 40 through the introducing pipe 60 shown in FIG. 3. At this time, by the action of the catalytic unit 64 disposed on the introducing pipe 60, the exhaust gases G are substantially purified. The purified exhaust gases G of an elevated temperature are, after having been introduced into the first expansion compartment 41 and hence expanded, introduced into the second expansion compartment 42 through the first communicating pipe 50 and thence into the third expansion compartment 43 through the second communicating pipe 52.

Also, the third expansion compartment 43 on the downstream end side with respect to the direction of flow of the exhaust gases G is communicated with the resonance compartment 48 and, therefore, a portion of the exhaust gases G introduced into the third expansion compartment 43 flows into the resonance compartment 48 through the connecting pipe 54. At this time, since the first expansion compartment 41, in which the exhaust gases G of a relatively high temperature exist, adjoins the third expansion compartment 43 and the resonance compartment 48, in which the exhaust gases of a relatively low temperature exist, and since the first communicating pipe 50 extends across the interior of the third expansion compartment 43, heat exchange takes place across the partition plate 57A and a wall surface of the first communicating pipe 50 so that the high-temperature exhaust gases G having flowed through the catalytic unit 64 can be effectively cooled.

As hereinabove described, after the exhaust gases G have repeatedly expanded and constricted within the chamber body 40, the exhaust gases G are introduced from the exhaust chamber 34 into the muffler 36 through the chamber outlet pipe 46 and are then discharged to the atmosphere. At this time, by the selective opening or closure of the exhaust control valve 72 disposed inside the chamber outlet pipe 46, the flow of the exhaust gases G to be supplied to the muffler 36 can be adjusted.

According to the foregoing embodiment, since as best shown in FIG. 4, the oxygen sensor 68 is disposed on the chamber inlet pipe 44, which is a part of the exhaust chamber 34, and the exhaust control valve 72 is disposed inside the chamber outlet pipe 46, which is also another part of the exhaust chamber 34, the structure of the chamber body 40 is so simplified as to simplify the interior structure inside the exhaust chamber 34 and, therefore, the assemblability of the exhaust chamber 34 can be increased as well. Also, since the exhaust control valve 72 and the oxygen sensor 68 are respectively mounted inside and on the chamber outlet pipe 46 and the chamber inlet pipe 44, both of which are fabricated in a substantially cylindrical shape, positioning and fixing thereof onto the exhaust chamber 34 can be facilitated as compared with the chamber body 40 that is fabricated in a complicated shape.

In addition, since the exhaust control valve 72 is disposed in the chamber outlet pipe 46, access to the exhaust control valve 72 can be made easy, compared with the structure in which the exhaust control valve is disposed interior of the chamber body, and therefore, maintenance and servicing of the exhaust control valve 72 can be facilitated. Also, since the exhaust control valve 72 is arranged downstream of the third expansion compartment 43 best shown in FIG. 3, the exhaust gases G of the elevated temperature, which have been substantially purified by the catalytic unit 64, flow past the exhaust control valve 72 in contact therewith after the temperature of the exhaust gases G has been reduced down to a relatively lower temperature as a result of the repeated expansion and contraction, and, therefore, an undesirable excessive increase of the temperature of the exhaust control valve 72 can be suppressed.

Further, since the exhaust control valve 72 is employed as a member separate from any of the collecting duct 32 and the muffler 36 both best shown in FIG. 4, the freedom of choice of the layout and the material of the collecting duct 32 and the muffler 36 can be expanded. By way of example, if the exhaust control valve 72 were to be disposed inside the muffler 36, there is the possibility that the function of the exhaust control valve 72 will be no longer maintained once the muffler 36 is replaced with another muffler and/or specific connection of the exhaust control valve 72 with the new muffler 36 required to maintain such function will become complicated. In contrast thereto, the foregoing embodiment does not require the exhaust control valve 72 to be disposed inside the muffler 36 and, therefore, even when the muffler 36 is replaced, the function of the exhaust control valve 72 can be maintained with no special work required. This explanation is equally true if the oxygen sensor 68 were to be mounted on the collecting duct 32 and the function of the oxygen sensor 68 is maintained if the collecting duct 32 is replaced with another one.

Also, considering that the catalytic unit 64 employed in the practice of the foregoing embodiment is disposed inside the exhaust chamber 34, the collecting duct 32 and the exhaust pipe 30 are no longer required to support the catalytic unit 64 and, therefore, they may not be made of a material that lends itself well to the support, for example, welding with the catalytic unit 64. Accordingly, the freedom of choice of material for the collecting duct 32 and the exhaust pipe 30 can be expanded.

Also, since the exhaust control valve 72, the catalytic unit 64 and the oxygen sensor 68 are all provided inside the exhaust chamber 34 to thereby integrate the exhaust chamber 34, not only can the number of component parts used and the cost be suppressed, but also the exhaust passage 38 (FIG. 1) can be designed to have a compact layout. Positioning of the catalytic unit 64 inside the introducing pipe 60, which defines an inlet to the chamber body 40, makes it possible to reduce the distance from the exhaust ports 28*a* (FIG. 1) of the motorcycle engine E to the catalytic unit 64 and, therefore, an increase of the temperature of the catalytic unit 64 can be accelerated, at the time the engine E is started, to accelerate activation of the catalytic unit 64.

Moreover, since the oxygen sensor 68 is so positioned as to protrude upwardly slantwise and outwardly as shown in FIG. 1, not only is it possible to avoid an undesirable interference of the sensor 68 and the cable 70 with the engine E, motorcycle frame structure FR and others, but also the appropriate motorcycle bank angle limit can be maintained. Also, since the casing 56, the chamber inlet pipe 44, the chamber outlet pipe 46, the introducing pipe 60 and the catalyst carrier 66 (FIG. 5), all of them forming the exhaust chamber 34 shown in FIG. 3, are all made of a homogeneous metal, specifically the stainless material, it is possible to avoid welding of dissimilar metals, when the catalytic unit 64 is to be welded, allowing the welding quality to be increased accordingly.

In addition, since the operating member 72*b* for driving the valve spindle 72*a* of the exhaust control valve 72 best shown in FIG. 6 is so inclined as to approach the widthwise center of the body of the motorcycle, it is possible to avoid an undesirable contact of the operating member 72*b* of the exhaust control valve 72 with a rider's foot. Yet, since the resonance compartment 48 best shown in FIG. 3 is communicated with the third compartment 43 on the downstream end side and since the temperature of the exhaust gases G within the downstream end expansion compartment 43 is lower as compared with that within the upstream expansion compartment 41 and 42, the resonant frequency within the expansion compartment 43 is lowered and the frequency is therefore easy to adjust.

Yet, as best shown in FIG. 1, the oil pan 15, a side stand (not shown), the power transmitting member 17 and others are arranged on the left side of the body of the motorcycle with respect to the widthwise direction of the motorcycle. In contrast thereto, the exhaust control valve 72 and the oxygen sensor 68 are arranged on the right side of the body of the motorcycle with respect to the widthwise direction relative to the exhaust chamber 34 and are left bared. Accordingly, the oil pan 15, the side stand, the power transmitting member 17 and others do not constitute any obstruction for the attendant worker to make access to the exhaust control valve 72 and the oxygen sensor 68 and, therefore, they can readily be inspected and serviced.

Furthermore, as best shown in FIG. 3, the chamber inlet pipe 44 having the oxygen sensor 68 mounted thereon and the introducing pipe 60 having the catalytic unit 64 disposed therein are formed as members separate from each other and, then, they are, after having been overlapped and integrated together, fixed inside the opening of the front casing 56F. When the chamber inlet pipe 44 having the oxygen sensor 68 mounted thereon and the introducing pipe 60 having the catalytic unit 64 disposed therein are fixed to the front casing 56F in the manner as hereinabove described, mounting of the oxygen sensor 68, fitting of the catalytic unit 64 to the pipe and fitting of this pipe to the chamber body 40 can be facilitated as compared with the oxygen sensor 68 and the catalytic unit 64 fitted to one and the same pipe.

Yet, since as shown in FIG. 1, the oxygen sensor 68 has its widthwise outer side covered by the fairing 27 and the exhaust control valve 72 (best shown in FIG. 4) has its widthwise outer side covered by the exhaust cowling 76, the appearance of the motorcycle can be increased and the oxygen sensor 68 and the exhaust control valve 72 can be protected from any obstruction during the travel of the motorcycle.

Yet, when the catalytic unit 64 shown in FIG. 4 is accommodated within the chamber body 40, the catalytic unit 64 can readily be warmed up to a temperature enough to allow the catalytic unit 64 to be optimally activated at the time the engine E is started, as compared with the system in which the catalytic unit 64 is disposed inside a pipe exposed to the outside, for example, the collecting duct 32.

Also, since a major portion of a side wall of the chamber body 40 is left bare to the atmosphere without being covered by any of the fairing 27 and the exhaust cowling 76, the incoming wind can smoothly flow along the side wall of the exhaust chamber 34 and an excessive temperature rise of the chamber, which would result from the reaction of the catalyst, can be advantageously suppressed. In particular, when the right front end portion, which is a portion adjoining the catalytic unit 64 shown in FIG. 3, is left bared, the excessive temperature rise of the exhaust chamber 34 can be effectively suppressed. Moreover, since the recesses 47 are formed in that portion of the right casing 56R, which form respective portions of the wall surface of the first expansion compartment 41, and those recesses 47 are exposed to the outside of the motorcycle, the surface area of the right casing 56R is increased and the heat dissipating characteristic of the first expansion compartment 41 in the chamber body 40, at which the temperature is apt to become relatively high, can be increased enough to effectively suppress the excessive temperature rise of the exhaust chamber 34.

Furthermore, the introducing pipe 60 is fluidly connected with a front area of a widthwise right end portion of the chamber body 40 and a part of the wall of the first expansion compartment 41 is formed by a front portion of the right casing 56R. Since, as compared with any of widthwise intermediate and rear walls of the chamber body 40, the front area of the widthwise side wall of the chamber body 40 is apt to be cooled in contact with the incoming wind during the travel of the motorcycle, the possibility of the temperature of the first expansion compartment 41 becoming too high can be avoided. Also, since the front portion of the right casing 56R of the chamber body 40 is so formed as to smoothly bulge in a direction widthwise outwardly of the motorcycle towards the rear as viewed from bottom, the incoming wind can smoothly flow along the wall surface and, as a result, heat exchange occurs between the incoming wind and the wall surface enough to further suppress the undesirable temperature rise of the first expansion compartment 41.

Yet, as best shown in FIG. 2, the space delimited in a bottom region of the motorcycle and between the engine E and the rear wheel 16 positioned rearwardly of the engine E is effectively utilized to accommodate the chamber body 40. In other words, the chamber inlet pipe 44 is located at a substantially widthwise center portion of the body of the motorcycle so as to protrude from the chamber body 40 towards the space below the engine E and, on the other hand, the chamber outlet pipe 46 fluidly connected with a rear portion of the chamber body 40 is located on the right side of the body of the motorcycle so as to protrude diagonally outwardly and rearwardly from the chamber body 40 towards a space on the right side of the rear wheel 16. Accordingly, an undesirable interference between both of the chamber inlet and outlet pipes 44 and 46 and both of the engine E and the rear wheel 16 can be advantageously avoided and, at the same time, the chamber body 40 disposed between the engine E and the rear wheel 16 can have a capacity as large as possible.

Figure 9:
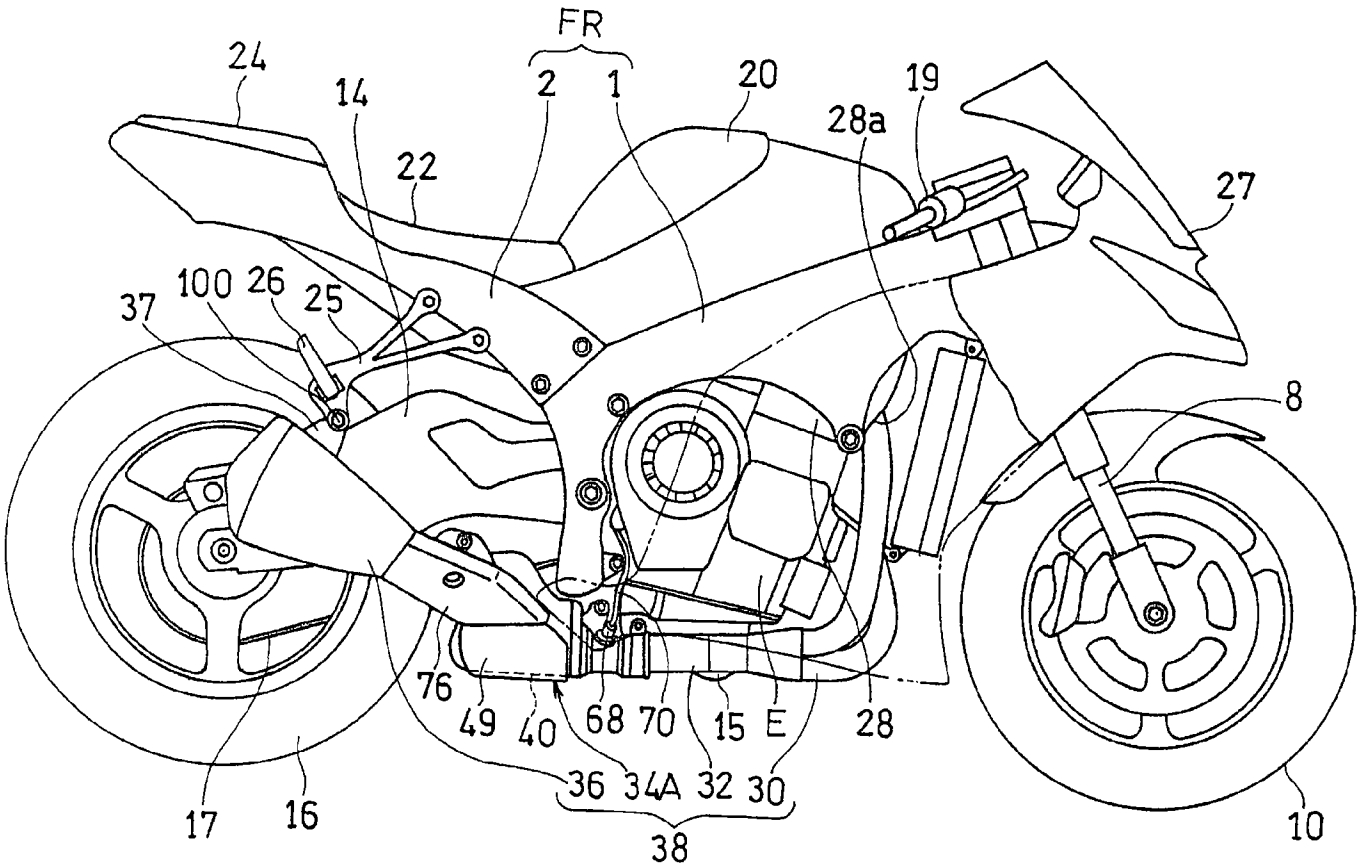
FIG. 9 is a schematic side view showing the motorcycle equipped with the exhaust chamber designed in accordance with another preferred embodiment of the present invention.

FIG. 9 illustrates a right side view of the motorcycle provided with the exhaust chamber 34A designed in accordance with a second preferred embodiment of the present invention. The exhaust chamber 34A according to this second embodiment differs from the exhaust chamber 34 according to the previously described first embodiment in respect of the chamber cowling 49 employed to cover a right portion of the chamber body 40 with respect to the widthwise direction of the motorcycle. Other than the use of the chamber cowling 49, the exhaust chamber 34A is similar in structure and function to the exhaust chamber 34.

The chamber cowling 49 employed in accordance with the second embodiment is prepared from a metal sheeting, made of the stainless material, by the use of any known bending technique and is fixed to the chamber body 40 by means of a connecting means such as, for example, welding. It is, however, to be noted that the material for and the method of fixing the chamber cowling 49 may not necessarily be limited to such as described above.

Figure 10:
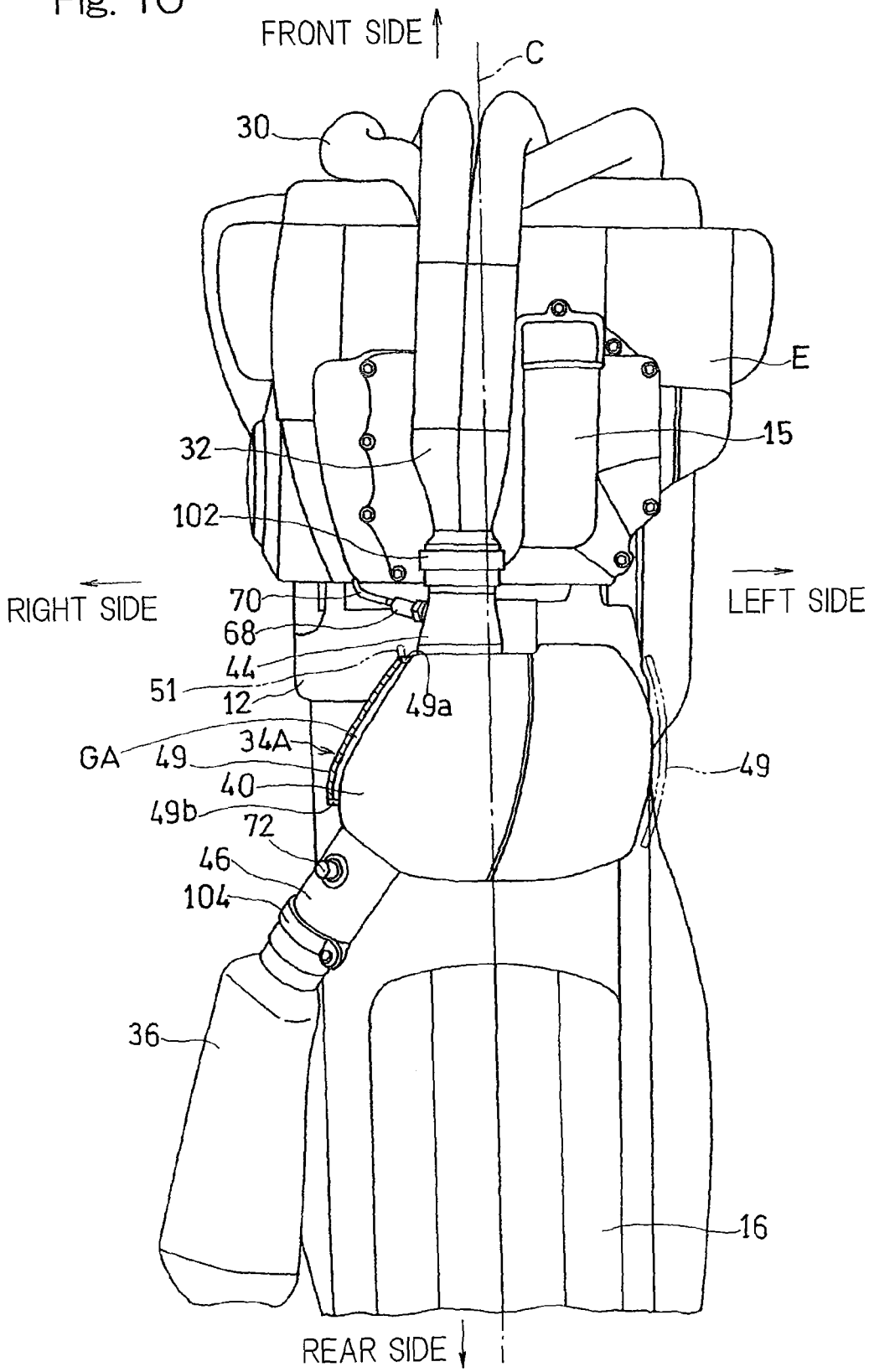
FIG. 10 is a schematic bottom plan view, with a portion broken away, showing the exhaust chamber in the motorcycle shown in FIG. 9.

According to this second embodiment, since an outer side face of the chamber body 40 is covered by the chamber cowling 49, a major portion of the exhaust chamber 34A is not left bare to the outside and, accordingly, the appearance of the motorcycle can be improved. Also, as best shown in FIG. 10, when a gap GA is provided between the chamber body 40 and the chamber cowling 49 and, also, openings 49*a* and 49*b* are formed respectively in front and rear end portions of the gap GA, the incoming wind can flow through a space delimited between the outer side wall of the chamber body 40 and an inner surface of the chamber cowling 49 during the travel of the motorcycle, allowing the chamber body 40 to be effectively cooled while exposure of a heat emitting area is avoided. In such case, a guide 51 for guiding the incoming wind towards the gap GA referred to above may be formed in a front end portion of the chamber cowling 49, but the gap GA referred to above is not always essential.

Although according to the second embodiment described hereinabove, the chamber cowling 49A has been shown and described as employed on the right side of the exhaust chamber 34, it may be employed on opposite sides of the exhaust chamber 34A. Also, although the chamber cowling 49 has been described as formed by fixing a metal sheeting, which has been bent, to the exhaust chamber 34A, the present invention may not necessarily be limited thereto. By way of example, the fairing 27 shown in FIG. 1 may have its rear portion either integrally formed or separately connected with an extended cowling so as to extend rearwardly thereof so that the outer side surface of the chamber body 40 can be covered or protected. Alternatively, the exhaust cowling 76 in FIG. 9 may be either integrally formed or separately connected with an extended cowling so as to protrude forwardly therefrom so that the outer side surface of the chamber body 40 can be covered or protected.

Also, the chamber cowling 49 may be fixed to the chamber body 40 with no gap or opening left in an edge portion over the entire perimeter thereof. By so doing, a sealed air layer can be formed between the chamber body 40 and the atmosphere and, therefore, even when the ambient temperature is relatively low, the interior of the chamber body 40 can be quickly warmed up to allow the catalyst to be quickly activated.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in any one of the foregoing embodiments of the present invention, the oxygen sensor 68 and the catalytic unit 64 have been shown and described as provided in the chamber inlet pipe 44 and the introducing pipe 60, respectively, the oxygen sensor 68 and the catalytic unit 64 may be fixed in one and the same pipe.

Also, a portion of the rear end wall of the chamber body 40 adjacent the rear wheel 16 may be provided with a heat insulating plate for avoiding transmission of heat to the rear wheel 16.

Accordingly, such changes and modifications are, unless they depart from the scope of the present invention as delivered from the claims annexed hereto, to be construed as included therein.

REFERENCE NUMERALS

16: Rear wheel
34: Exhaust chamber
36: Muffler
38: Exhaust passage
40: Chamber body
41: First expansion compartment
42: Second expansion compartment
43: Third expansion compartment
44: Chamber inlet pipe
46: Chamber outlet pipe
48: Resonance compartment
60: Introducing pipe
64: Catalytic unit
66: Catalyst carrier
68: Exhaust gas sensor (Oxygen sensor)
72: Exhaust control valve
72*b*: Opening member
E: Combustion engine
G: Exhaust gases

What is claimed is:

1. An exhaust chamber for a motorcycle disposed at a location upstream of a muffler in an exhaust passage leading from a combustion engine, which is a member separate from the muffler and comprises:

a chamber inlet pipe protruding in an upstream direction from a chamber body for allowing the exhaust gases to flow therethrough into the chamber body;

a sensor fitted to the chamber inlet pipe for detecting a composition of the exhaust gases within the exhaust passage;

an introducing pipe having an introducing passage defined therein, the introducing pipe being disposed within the chamber body for introducing the exhaust gases, which have flowed through the chamber inlet pipe, into a first expansion compartment of the plurality of expansion compartments in the chamber body;

a catalytic unit disposed within the introducing passage inside the introducing pipe for purifying the exhaust gases entering the first expansion compartment;

the chamber body having a first expansion compartment in fluidic connection with a second expansion compartment and a third expansion compartment in fluidic connection with the second expansion compartment, the third expansion compartment is in fluidic connection with a resonance compartment, wherein the first expansion compartment shares a heat exchanging partition plate with respectively the resonance compartment and the third expansion compartment to reduce heat in the first expansion compartment and the catalytic unit;

a chamber outlet pipe having an outlet passage defined therein for discharging exhaust gases from the chamber body; and an exhaust control valve disposed in the chamber outlet pipe for adjusting a sectional area of the outlet passage inside the chamber outlet pipe, wherein a rear end portion of the chamber outlet pipe is connected with a front end of the muffler.

2. The exhaust chamber for the motorcycle as claimed in claim 1 wherein the chamber outlet pipe protrudes rearwardly from a rear end portion of the chamber body.

3. The exhaust chamber for the motorcycle as claimed in claim 1 wherein the chamber outlet pipe includes an exhaust cowling overlaying the chamber outlet pipe and the exhaust control valve.

4. The exhaust chamber for the motorcycle as claimed in claim 1, wherein a chamber cowling is mounted on an exterior of the chamber body with a gap configured to direct a flow of air to provide a heat exchange with the chamber body on a first side of the motorcycle and on an opposite second side of the motorcycle while protecting the rider from contact with the exhaust chamber.

* * * * *